United States Patent [19]

Hurd

[11] 4,032,329

[45] June 28, 1977

[54] METAL REDUCTION PROCESS EMPLOYING METAL SUB-HALIDES

[75] Inventor: Frank W. Hurd, Minneapolis, Minn.

[73] Assignee: University of Minnesota, Inc., Minneapolis, Minn.

[22] Filed: Feb. 20, 1976

[21] Appl. No.: 659,812

[52] U.S. Cl. ..... 75/84.5; 75/84.4

[51] Int. Cl.$^2$ ..... C22B 34/10

[58] Field of Search ..... 75/84.4, 84.5

[56] References Cited

UNITED STATES PATENTS

| | | | |
|---|---|---|---|
| 2,787,539 | 4/1957 | Conklin | 75/84.5 |
| 2,920,952 | 1/1960 | Monson | 75/84.5 |
| 2,986,462 | 5/1961 | Wright | 75/84.5 |
| 3,736,132 | 5/1973 | Morse et al. | 75/84.5 |
| 3,801,307 | 4/1974 | Hurd | 75/84.1 R |
| 3,839,020 | 10/1974 | Honma et al. | 75/84.5 |

*Primary Examiner*—Brooks H. Hunt
*Attorney, Agent, or Firm*—Jones, Tullar & Cooper

[57] ABSTRACT

This invention relates to an improved process for controlled reduction of sub-halides of certain multivalent metals, preferably titanium and zirconium. In the process a metal sub-halide is reacted with an alkali metal, such as sodium, so that the reaction temperature reaches at least about 975° C. and preferably at least about the boiling point of the alkali metal halide. The reduction reaction is conducted in a manner so that the reduced metal does not contact undesirable metal, such as the outer reaction vessel.

13 Claims, No Drawings

METAL REDUCTION PROCESS EMPLOYING METAL SUB-HALIDES

CROSS REFERENCE TO RELATED DISCLOSURE DOCUMENT

Applicant hereby claims the benefits of Disclosure Document No. 028719, filed Feb. 22, 1974, which is hereby incorporated by reference.

BACKGROUND OF THE INVENTION

In the various prior art processes wherein metals are produced from metal sub-halides, the resultant product metal is contaminated, at least to some extent, by by-product metal halide. Various means are proposed for separating the product metal and metal halide, including separate reduction and sponge growth reaction stages.

The process of the invention provides a method which yields good product metal/by-product metal halide separation, while providing a product metal sufficiently massed, agglomerated or consolidated so that it is readily handleable and processable.

U.S. Pat. Nos. 2,896,462; 2,950,963 and 3,069,255 describe methods of producing metals from metal sub-halides by multistage processes.

Other patents which describe related reduction processes include U.S. Pat. Nos. 2,963,632; 2,824,799; 2,910,357; 2,944,888 and 2,956,862.

The concept of a porous inert insulating layer between reacting components and the side walls of a reactor has been described in conjunction with the thermite process (Z. anorg. Chem. 64, 2n-24; C.A. 4, 874, [1910]). Insulation layers have also been used in the reduction of uranium and thorium (H. A. Whilhelm et al., Journal of Chem Ed., 37, 56, [1960]).

DESCRIPTION OF THE INVENTION

The process of this invention is generally applicable to the complete reduction of halides of multivalent metals which are reducible, in an intermediate stage, to at least one sub-halide by a reducing metal, such as an alkali metal, for example, sodium. The process allows for the preparation of partially consolidated metal from the metal halide.

The metal halides which can be reduced by the process of the invention include, but are not limited to the chlorides, iodides and fluorides of titanium, zirconium, tungsten, chromium, hafnium, plutonium and uranium. The preferred metals are titanium and zirconium. The preferred halides are the chlorides. For purposes of illustration, the invention is exemplified by the reduction of titanium tetrachloride by an insufficiency of sodium to provide a mixture of titanium trichloride and sodium chloride. The sub-halide is then contacted with sufficient sodium to complete the reduction reaction, in a manner that the reaction temperature approximates the boiling point of sodium chloride. Upon cooling, the reaction mixture comprises titanium containing little or no occluded by-product sodium chloride. The adaptability of the invention to other metal halides, such as set forth above, is readily achieved.

The term "sub-halide" is used herein to refer to metal halides in which the valence state of the metal of interest is less than the valence state of that metal in the primary halide form from which the sub-halide is produced by partial reduction. While the sub-halide can be utilized in purified form, usually the sub-halide is utilized as a mixture of the sub-halide and an alkali metal salt, i.e. the product of a first partial reduction of the primary halide to form the sub-halide. Various methods are known to prepare sub-halide/by-product salt mixtures. A number of these methods are described in U.S. Pat. No. 2,986,462, which is hereby incorporated by reference. For example, approximately one mole of sodium is reacted wih one mole of titanium tetrachloride, i.e. $TiCl_4+Na \rightarrow TiCl_3.NaCl$. Physically, this reaction product takes the form of granulated $TiCl_3.NaCl$. $TiCl_2.2NaCl$ can be produced in a similar manner.

In the process of the invention, the product metal sub-halide is contacted with sufficient reducing metal, e.g., sodium in a manner so that the temperature reached in the reduction reaction zone is at least about 975° C., and preferably at least about the boiling point of the by-product reducing metal halide, in the case of sodium chloride at least about 1400° C.–1500° C.

The sub-halide and reducing metal are preferably initially contacted at a temperature below the thermal initiation temperature of the reduction reaction. This can usually be accomplished at room temperature. The reactants can be admixed or layered depending on the temperatures involved. Where the reactants are less than intimately commingled prior to reaching the thermal initiation temperature, complete, rapid reaction can be assured utilizing the shaking principle taught in U.S. Pat. No. 3.801,307, which is hereby incorporated by reference. Generally, the reduction reaction is initiated by heating the reactants to a relatively low temperature, for example, between about 150° C. to 400° C. The reaction can be exemplified as:

$$3Na+TiCl_3.NaCl \rightarrow Ti+4NaCl.$$

When possible, the relative amounts of reducing metal and metal sub-halide which are used in the practice of this invention should be substantially stoichiometric. Ordinarily, it is not necessary to use any significant excess of either of the reactants, and the use of substantial excesses, for example, over 25% excess of either reactant should be avoided. Ordinarily, the process of this invention requires less than 10% excess of either reactant, and desirably less than 5% excess of either reactant. Preferably, less than 1% excess of either reactant is most desirable.

As previously stated the temperature of the reduction reaction should rise to at least about 975° C.; more preferably above about 1200° C. and most preferably to about the boiling point of the by-product reducing metal halide. Once the thermal initiation temperature is exceeded, the reduction reaction is exothermic. The temperature in the reaction zone can be calculated by well known procedures. The selection of the reactants in part governs the heat generated in the reduction zone. For example, the complete reaction between sodium and titanium trichloride releases substantially more heat than the complete reduction of titanium dichloride by sodium. By controlling the initial heat content of the reactants, the heat output of the reduction reaction (by the selection of the sub-halide or mixtures thereof) and the application of external heat (or cooling) to the reaction zone, if necessary, the desired peak reaction temperatures can be predicted and achieved. Practical experience will rapidly allow adjustment of these parameters to achieve the desired results in any particular equipment, since, in practice, heat losses or heat transfer lags can be anticipated.

The peak reaction temperature can be raised by heating the reducing metal, for example, sodium, to a temperature between its melting point and its boiling point. If this temperature is above the thermal initiation temperature of the desired reduction reaction, the reactants are contacted within the reaction zone at the time the reaction is desired. In addition, or alternatively, the peak reaction temperature can be increased by heating the sub-halide prior to contacting the sub-halide with the reducing metal.

In yet another embodiment, the sub-halide can be admixed with an amount of the primary metal halide. The amount of reducing metal employed in the reduction reaction is stoichiometrically adjusted to be sufficient to completely reduce the total product metal halide present. In this manner, the heat content of the final reaction products is increased since, for example, the reaction $TiCl_4+4Na \rightarrow Ti+4NaCl$ has a $\Delta H$ of $-211$ kcal./g. mol. Ti, whereas $TiCl_3+3Na \rightarrow TiCl_3+3\ NaCl_3$ has a $\Delta H$ of only $-123$ kcal./mol. $TiCl_2$ reduction provides an even lower $\Delta H$.

In addition, the presence of primary product metal halide in the reaction zone can be used to raise the thermal initiation temperature, if admixing the sub-halide and reducing metal is insufficient to raise the temperature of the reaction product sufficiently high.

While various embodiments have been discussed above for controlling the reaction temperature, variants of these procedures, including means for adding auxiliary heat or even cooling to the reaction zone, other than specifically described but obvious to those skilled in the art, may be employed.

While it is essential for the purposes of the invention to attain at least a minimum peak exotherm, it is also highly desirable, but not completely essential, to select the conditions which provide a peak exotherm not substantially above about the boiling point of the by-product halide, since significant pressures are generated upon heating gaseous materials. The heat of vaporization of the by-product halide is significant and thus becomes an aid in maintaining the maximum temperature at about the boiling point of the by-product halide, as long as the parameters above are reasonably observed. Obviously, the stronger the outer reaction vessel, the less critical control of the maximum temperature need be.

The formation of product metal is conducted in a manner which prevents the reactants from contacting undesirable metals during the course of the reduction reaction. Since the reaction vessel usually employed in related reduction reactors is steel, at the temperatures employed therein there is a substantial likelihood that, if the reactants were to contact the walls of such a reactor, the product metal would adhere to or alloy with the reactor metal thereby seriously contaminating the product metal. For example, titanium metal attacks iron at about 975° C. even if the product metal is not contaminated by the reactor metal, the reaction heat may tend to weaken or burn through the reactor wall.

In the process of the invention, the outer reaction vessel is lined with an insulating or spacing material leaving an internal cavity in which the reduction reaction is conducted. The insulating material prevents contact of the reaction mass with the inner walls of the outer reaction vessel at elevated temperatures. The insulating material may be virtually any inert or relatively inert high melting material. Where an inner reaction container, as described hereinafter, is employed, the insulating material can melt at or above the melting point of the by-product halide and can in fact be the same halide. Where no inner reaction container is employed the insulating material should melt above the melting point of the by-product halide. Preferably, the insulating material is a particulate or granular material which can be compacted to provide a relatively inactive porous layer.

In another embodiment, the insulating layer may be formed by the use of a high melting molten material such as a metal salt, which is cast to the desired shape in molten form or sintered and allowed to cool.

The insulating material must be a high melting material so that it will perform as a barrier to prevent high temperature product metal from reaching the interior walls of the reaction vessel. In some instances, the insulating material will partially melt in the course of the reaction.

The thickness of the layer of the insulating material is dependent on the nature of the reactants and the quality thereof, as well as the nature and form of the insulating material itself. The thickness should be at least sufficient to prevent substantial contact of the products with the interior surface of the outer reaction vessel. The use of a substantial excess of the insulating material is not necessarily deleterious.

The insulating material should be relatively inert to the reactants. However, a material which is not truly totally inert, in a chemical sense, may be employed as the inert insulating material so long as the product metal is not contaminated. Further, where an alkali metal or alkaline earth metal salt, for example, a halide or an alkaline earth metal oxide, is employed, as the insulating material, even if some interchange between the reducing metal and the alkali metal or alkaline earth metal ion in the insulating material does occur, the exchanged ion also functions as a reducing metal at the temperatures in the reaction zone, and thus it does not substantially detract from the principal reaction. Thus, where sodium is used as a reducing metal and calcium fluoride is the insulating material, even if a relatively small amount of exchange between sodium and calcium were to take place, the calcium is in effect a reducing metal. Such an exchange would not affect the reaction yield or cause contamination of the product metal and thus for the purpose of this invention calcium fluoride would be considered an inert insulating material.

A highly satisfactory insulating material is calcium fluoride. However, a by-product alkali metal or alkaline earth metal compound, such as a halide or oxide, may be employed. Other insulating materials include $ZrO_2$, $TiO_2$, cermet, electrically fused dolomitic oxide, or finely divided metal, especially where the metal is the same as the metal formed in the reduction reaction.

In one preferred embodiment, the reduction reaction is conducted in a manner that the reactants are enclosed in or initially contained by an inner container, which is a beneficial metal container. This container is placed within the internal cavity in the insulating material. The inner container can be formed from the metal or an alloy of the metal which is the product metal. The inner container may also be formed from any metal forming a desirable alloy with the product metal. Such metals as described above are termed beneficial metals. The choice of the desired product metal or the end use of the product metal will govern to some extent the choice of the inner metal container employed.

The exact physical nature of the inner container is subject to wide variation. It may be a cup or bowl and may be an open or closed container. The use of a closed cylinder is preferred.

The thickness of the inner container is also subject to wide variation. It may be a metal foil or a container of substantial thickness.

The means for providing a closed inner container are not critical and the closure may be obtained by the use of welding, a threaded cup, fasterners such as nuts and bolts, crimping, inert adhesives or any other suitable closure means.

Where a closed inner container is employed, in one embodiment the reactants, the sub-halide, and the reducing metal, are separated within the container by a system, preferably midway within the inner container, until the reactants have been raised above the thermal midway initiation temperature of the reduction reaction, and the reducing metal is molten. The system is then ruptured, allowing the reactants to commingle and the reduction reaction to proceed. The system can be a beneficial metal foil or a plastic material which has sufficient strength to separate the material at a desired temperature, at least about the reduction reaction initiation temperature; yet which can be ruptured by a sharp external force acting on the weight of the separated reactants or which can be ruptured by means placed within the inner container.

The use of a beneficial metal inner container, as well as the use of septum within that container in conjunction with an inert insulating material in a metal reduction process is described in copending application Ser. No. 625,352, which is hereby incorporated by reference.

It is highly preferred that the reduction reaction take place in the absence of oxygen, nitrogen, carbon dioxide or moisture. Thus, one skilled in the art would recognize that the reactants are charged into the reaction zone in a manner as to exclude substantial amounts of reactive gases or moisture. This can be accomplished by operating under and/or flushing the system with an inert gas such as helium or argon. The separation of the by-product reducing metal halide and the product metal can be aided by reducing the pressure in the reaction zone, for example, prior to initiating the reduction reaction.

While the reducing metal is most preferably sodium, other alkali metals such as potassium can be employed. It has also been noted that minor amounts of calcium may be employed in admixture with the alkali metal as the reducing metal. In some cases, higher yields of desirable product metal can be obtained by employing such a reducing metal mixture.

The reduction reaction proceeds rapidly at the temperature employed and the temperatures contemplated by this invention need not be maintained for any substantial time after the reduction reaction is complete.

At the completion of the reduction reaction, the reactor is cooled and the product metal recovered from the reactor in partially consolidated form. Any residual by-product halide may be removed from the consolidated metal by any other technique previously described in the art.

The process of the invention can be exemplified by the following:

A titanium trichloride-sodium chloride mixture was formed by reacting titanium tetrachloride with sodium in a molar ratio of 1:1. The resultant product was stable in an argon atmosphere and displayed the color characteristics of titanium trichloride.

A steel outer reaction vessel such as described in U.S. Pat. No. 3,801,307 and copending application Ser. No. 625,352, filed Feb. 22, 1974, was lined with compacted ignited calcium fluoride (−200 mesh) to form a cavity wherein the reduction reaction is subsequently conducted. Liquid sodium was placed in the cavity and allowed to congeal. A stoichiometric amount (1 mole of $TiCl_3$ to 3 mole sodium) of $TiCl_3.NaCl$ was placed on top of the sodium. A cake of compacted and partially fused calcium fluoride closed the reaction cavity. An argon blanket was used where necessary.

The reaction vessel was sealed and heated in order to initiate the reduction reaction. The sodium was melted and commingled with the $TiCl_3.NaCl$ to assure rapid complete reaction. The reaction was exothermic and the peak exotherm achieved was about the boiling point of sodium chloride. Upon cooling, the reactor yielded partially consolidated titanium substantially separated from the sodium chloride.

In a similar manner or any manner contemplated in the above description, various other sub-halides may be employed and other metals produced within the scope of this invention.

Though the present invention has been illustrated above in a number of varying forms, the invention is not to be considered limited to the precise details, but may be practiced otherwise without departing from the scope of the invention defined by the appended claims.

I claim:

1. A reduction process for the production of a product metal selected from the group consisting of titanium, zirconium, tungsten, chromium, hafnium, plutonium and uranium from a sub-halide of said product metal, which includes the step of reacting the product metal sub-halide with an alkali metal reducing metal in a manner such that the temperature of the reaction mixture reaches at least about 975° C, while insulating the reaction mixture from contact with an outer reaction vessel by means of a relatively inert insulating material having a melting point above about the melting point of the reducing metal halide formed in the reduction reaction.

2. A process, as in claim 1, where the reduction reaction is conducted in a manner such that the temperature of the reaction mixture reaches a temperature between about 1200° C and about the boiling point of the reducing metal halide formed in the reduction reaction.

3. A process, as in claim 1, where the reduction reaction is conducted in a manner such that the temperature of the reaction mixture reaches a temperature at least about the boiling point of the reducing metal halide formed in the reduction reaction.

4. A process, as in claim 1, where the sub-halide is employed as a mixture of the sub-halide and reducing metal halide formed by the incomplete reduction of the product metal primary halide with a stoichiometric insufficiency of the alkali metal reducing metal.

5. A process, as in claim 1, where the product metal is titanium or zirconium.

6. A process, as in claim 1, where the halide is a chloride.

7. A process as in claim 1 where titanium or zirconium are produced from a sub-chloride.

8. A process, as in claim 7, where the reduction reaction is conducted in a manner such that the temperature of the reaction mixture reaches a temperature between about 1200° C and about the boiling point of the reducing metal halide formed in the reduction reaction.

9. A process, as in claim 7, where the reduction reaction is conducted in a manner such that the temperature of the reaction mixture reaches a temperature at least about the boiling point of the reducing metal halide formed in the reduction reaction.

10. A process, as in claim 7, where the sub-halide is employed as a mixture of the sub-halide and reducing metal halide formed by the incomplete reduction of the product metal primary halide with a stoichiometric insufficiency of the alkali metal reducing metal.

11. A process, as in claim 7, where the sub-halide comprises titanium trichloride.

12. A process, as in claim 7, which includes the steps of:

a. placing a sub-halide of titanium or zirconium in admixture with a reducing metal halide, and a reduction metal capable of reducing said sub-halide in a metal container, said metal container comprising the product metal or a metal which alloys with said product metal;

b. sealing said metal container containing the reactants in a reaction vessel, the metal container being spaced from the walls of said reaction vessel by means of a relatively inert insulating material;

c. initiating a reduction reaction and reacting the reactants in a manner such that the reaction mass reaches a temperature about the boiling point of the reducing metal halide formed in the reaction;

d. removing the product metal from the reaction zone.

13. A reduction process for the production of a product metal selected from the group consisting of titanium, zirconium, tungsten, chromium, hafnium, plutonium and uranium from a sub-halide of said product metal, which includes the step of reacting the product metal sub-halide with an alkali metal reducing metal in an inner reaction container in a manner such that the temperature of the reaction mixture reaches at least about 975° C, while insulating the inner reaction container from contact with an outer reaction vessel by means of a relatively inert insulating material having a melting point at or above about the melting point of the reducing metal halide formed in the reduction reaction.

* * * * *